US006068031A

United States Patent [19]

Lataix et al.

[11] Patent Number: 6,068,031

[45] Date of Patent: May 30, 2000

[54] TRANSFER SYSTEM BETWEEN A BAG AND A STERILE ENCLOSURE

[75] Inventors: Gilbert Lataix, Clermont Ferrand; Charles Wicky, Jungholtz, both of France

[73] Assignee: Laboratoires MSD- Chibret, Paris, France

[21] Appl. No.: 09/068,881

[22] PCT Filed: Nov. 20, 1996

[86] PCT No.: PCT/EP96/05117

§ 371 Date: May 21, 1998

§ 102(e) Date: May 21, 1998

[87] PCT Pub. No.: WO97/18994

PCT Pub. Date: May 29, 1997

[30] Foreign Application Priority Data

Nov. 22, 1995 [FR] France ..... 95 14054

[51] Int. Cl.[7] ..... B65B 1/04

[52] U.S. Cl. ..... 141/346; 141/114; 141/329

[58] Field of Search ..... 141/346, 330, 141/329, 363, 364, 114, 98; 222/81, 88

[56] References Cited

U.S. PATENT DOCUMENTS 4,715,165 12/1987 Thorogood .
5,370,164 12/1994 Galloway ..... 141/329
5,743,313 4/1998 Josefsson ..... 141/114

FOREIGN PATENT DOCUMENTS 0 317 908 A1 5/1989 European Pat. Off. .
2 338 869 8/1977 France .
WO95/03246 2/1995 WIPO .

*Primary Examiner*—Steven O. Douglas
*Attorney, Agent, or Firm*—Elliott Korsen; James M. Hunter, Jr.; Mark R. Daniel

[57] ABSTRACT

A sterile transfer system between a bag and a enclosure suitable for use in the pharmaceutical industry, characterized on the one hand of a first part of a bag having a mouth in the form of a pocket, in which the bottom is constituted by a flexible partition separating the interior spaces of the pocket and the bag and capable of being heat-cut, on the other hand a lock chamber installed at the entrance to the sterile enclosure which includes a fixed part on which the pocket can be mounted, this part presenting a central opening receiving a mobile element constituting the door of the lock chamber, the fixed and mobile parts each being equipped with a heatable blade with closed outline overlapping and joined at their apex in airtight manner when the bag is in the closed state, vacuum outlets being provided for applying the flexible partition by means of suction against the heatable blades and effecting the cutting of it by fusion of the zones which come into contact with the blades. Possible application notably in the pharmaceutical, cosmetic industry and in the medical field.

28 Claims, 12 Drawing Sheets

FIG.10
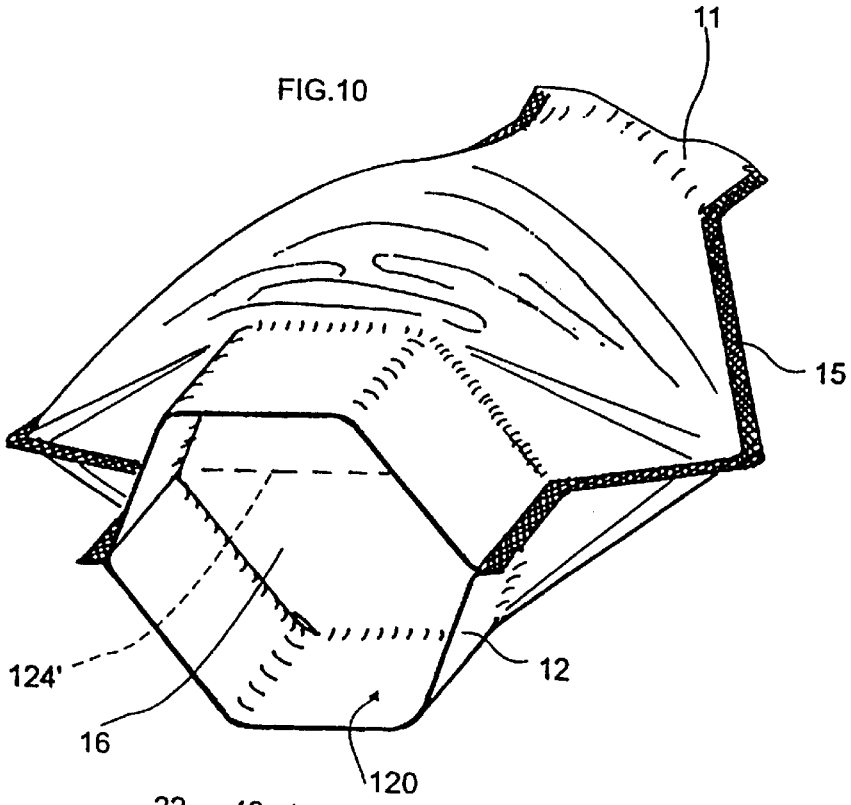
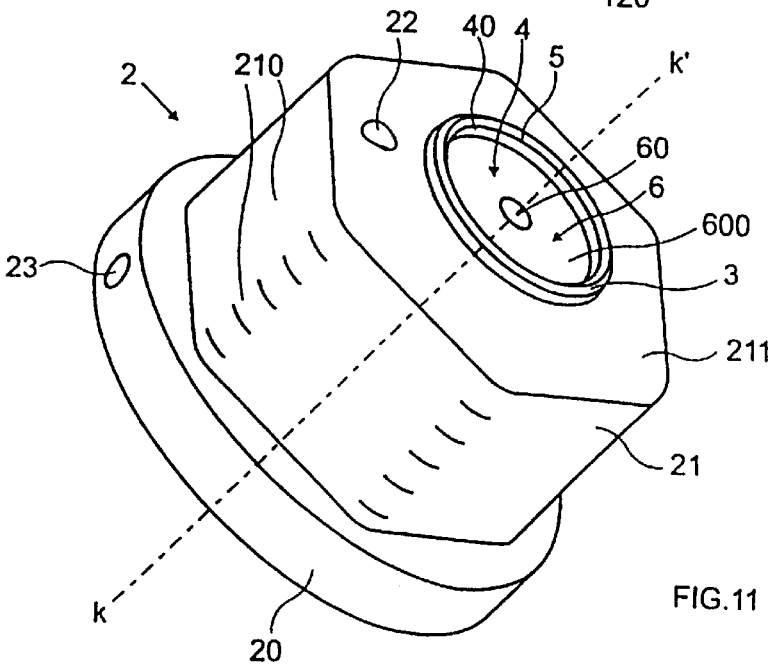
FIG.11

TRANSFER SYSTEM BETWEEN A BAG AND A STERILE ENCLOSURE

BACKGROUND OF THE INVENTION

This invention concerns a transfer system, guaranteed sterile, between a bag and a sterile enclosure, by means of a cutting transfer lock chamber.

This invention is intended particularly, but not exclusively, for the pharmaceutical industry and/or the medical field, for the economic transfer of loose products or liquids or individual sterile articles from a bag to a sterile enclosure or the reverse.

The transfer of previously sterilised products contained in a bag (or other container) to a sterile enclosure or zone presents a problem when the said products cannot be autoclaved or heat-sterilised or when they cannot be filtered (in the case of liquids).

The principal methods currently known for carrying out such a transfer are as follows:

1) Bags or containers are used which are equipped with special doors such as those marketed by "LA CALHENE", DPTE ("airtight transfer double door"), in accordance with the principle which is the subject of patent FR-A-1 346 486.

SUMMARY OF THE INVENTION

This method guarantees a sterile transfer; however, it also carries the inconvenience that the doors are expensive and have a limited lifetime, furthermore, the return circulation of the containers equipped with these doors must be managed, which poses practical problems of storage and maintenance.

2) Also known is the external sterilisation using a sterilising agent (notably of the paracetic acid $+H_2O_2$ type) of bags or containers placed in an entry enclosure, then put in communication with the sterile enclosure once sterilisation of the bags or containers and the entry enclosure has been carried out.

This type of method guarantees a sterile transfer but it is a slow method. In effect, desorption of the sterilisation product must be awaited before carrying out the transfer; in addition, the problem of migration of the sterilising products into the bags or containers must also be taken into account.

3) Finally, another known method is the sterilisation of bags or containers together, placed in another bag.

The first bag having been opened on the non-sterile side, the interior bag is transferred into the sterile area through a lock chamber which can be equipped with germicide tubes. This method does not guarantee a strictly sterile transfer. This is why it is mainly used in semi-sterile blocks, in the interior of which the operating personnel is physically present as, here again, sterility is not guaranteed.

Through document FR-A-2 338 869, a process and an appliance are also known which are supposed to enable the discharge of a sterile receptacle in a sterile environment.

According to this process, the bottom of the receptacle containing the items to be transferred, such as stacked cups for example, is cut by a knife with a closed outline, on which the cutting edge can have been previously heated.

To prevent contamination, before the bottom is cut, it is covered with an adhesive strip of which the exterior surface, on the side of the sterile enclosure, is also sterile.

In practice, the effectiveness of such a process is problematic, as contaminated particles sandwiched between the bottom of the receptacle and the adhesive, in which airtightness is not monitored at all, are also liable to be transferred during the operation following cutting.

Furthermore, this process requires the affixing of an adhesive film, the sterility of which is also difficult to monitor and which—in any event—puts a marked strain on the costs of the transfer operation.

This invention has as its objective the resolution of the difficulties associated with the above-mentioned technique, by offering a system which can provide a guaranteed sterile transfer, particularly suited, although not limited to, sterile objects and materials, the design of which enables in addition a reduction in the cost both of the operation and of the packaging required, as well as in the time needed for the operation.

These different objectives are achieved by means of the transfer system which is the subject of the invention, in that:

a) the bag has at least one mouth in the form of a pocket, in which the bottom is composed of a flexible partition made from material which is capable of being heat-cut by fusion, which separates the interior spaces of the pocket and the bag;

b) the entrance to the enclosure is equipped with a lock chamber composed of a fixed exterior part, in the form of a sleeve and an interior mobile part, constituting the door of the lock chamber;

c) the fixed and mobile parts are both fitted with a heatable blade with closed outline, one exterior integral to the fixed part and the other interior integral to the mobile part, these two blades overlapping and being joined at their apex, in an airtight manner, when the lock chamber is in the closed state;

d) the lock chamber and the mouth of the bag in the form of a pocket are formed in such a way that it is possible to mount this mouth on the exterior part, the flexible partition then coming into place in relation to the set of blades (lock chamber closed);

e) the lock chamber is equipped with vacuum outlets designed to apply the flexible partition by means of suction against the heatable blades and to effect its cutting by fusion of the areas coming into contact with the blades.

Moreover, in accordance with a certain number of advantageous, non-limitative characteristics of the invention:

- the said fixed part of the lock chamber has a polygonal-shaped head, hexagonal for example, on which the mouth of the bag is mounted;
- the system comprises means of holding the mouth of the bag on the fixed part, for example an inflatable sleeve;
- vacuum outlets are provided both in the interior and on the exterior of the set of blades and close to them;
- the said blades are metal blades heated electrically, for example by a high frequency current or by Joule effect (heating elements);
- the lock chamber is equipped with the means of cooling the blades;
- the blades have a circular outline;
- the mobile part of the lock chamber is equipped with a sliding central element, forming a piston, traversed by a vacuum channel and on which the frontal surface is designed to act as support for the central zone of the partition;
- the lock chamber is fitted at the entrance to the enclosure in such a way that it can be removed, as an airtight door collar can be fitted there in its place.

The invention also concerns a bag for a transfer system such as mentioned above, this bag being remarkable in that it is made of plastic material and is produced by heat-sealing from a plastic sheath or sheets and presents, when flat a transfer zone presenting a mouth constituted by a folded zone, which can be expanded to form a flat-bottomed pocket adaptable to the lock chamber.

Furthermore, according to a certain number of additional characteristics, non-limitative, of this bag:

- the transfer zone is produced by a seal in the folded zone involving a change of direction at an angle greater than or equal to 30° and located at a distance from the fold and short of it which is equal to approximately 0.3 times the width of the opening of the flattened pocket;
- the neck above the transfer zone is shaped in such a way that it can be turned over and threaded onto the fixed part of the lock chamber after opening of the lock chamber, to make a funnel and protect the contents of the bag from contact with the exterior blade;
- the bag is shaped in such a way that it is possible to make it temporarily airtight which isolates the interior of the bag from the transfer zone;
- the internal surfaces of the pocket-shaped mouth are protected from contamination by at least one airtight seal;
- the bag comprises at least one inflation appendage;
- the bag is provided, at its mouth, with means of gripping, facilitating the expansion to shape of the pocket and its mounting on the lock chamber;
- its mouth is folded double, in such a way as to form a peripheral groove capable of receiving, by means of interlocking, an element for expanding to shape and rigidifying the pocket.

Other characteristics and advantages of the invention will appear from the description and the drawings in annex which show, by way of example of non-limitative embodiment, possible methods of embodiment of it.

DESCRIPTION OF THE DRAWINGS

FIG. 10 illustrates in perspective the bag transfer zone following the expansion to volume of the pocket-shaped mouth which has a hexagonal shape;

FIG. 11 is a perspective view representing the transfer lock chamber which also forms part of the system according to the invention, lock chamber found at the entrance to a sterile enclosure not shown;

DETAILED DESCRIPTION OF THE INVENTION

Figure 1:
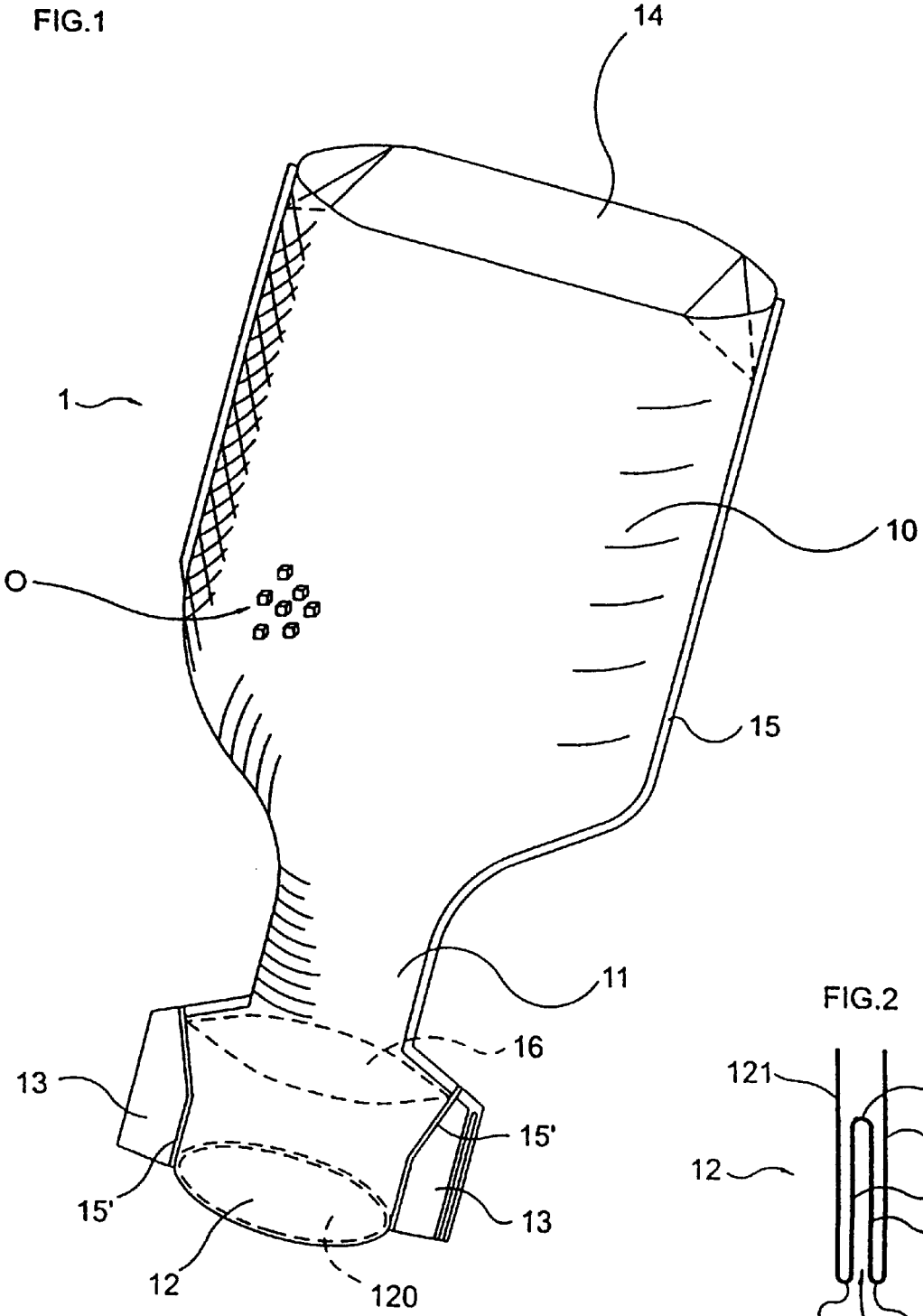
FIG. 1 is a perspective diagrammatic view of a flexible bag made of plastic material, a component of the system which is the subject of the invention.

The bag 1 shown in FIG. 1 is a bag with flexible walls, produced from a sheet of plastic material, transparent or non-transparent, which can be heat-cut by fusion, for example polyethylene with a low level of thickness, of the order of 120 micrometers.

It concerns an airtight envelope, its edges hermetically sealed by a line of heat-sealing 15 which integrates the front and rear surfaces of the envelope.

The seal, initially incomplete, is, of course, completed around the entire surrounding edge of the envelope after the products or articles which are to be contained in the bag have been introduced into it; in the drawing, a few articles are shown contained in the bag, using the reference O.

It concerns sterile products, the bag's interior space also-being sterile, either because the filling has taken place in a sterile chamber or because the bag and its contents have been sterilised after filling.

Reference 10 has been used to designate the main body of the bag, reference 11 its neck through which the products or articles contained within the body 10 will pass to be transferred into the sterile enclosure, as will be explained below.

The neck 11 opens into a mouth zone 12 which, as will also be seen below, affects the form of a pocket in which the open side opens towards the exterior (towards the bottom of FIG. 1). At the opposite end (towards the top of the figure), the bag has a bottom 14.

On each side of the mouth 12, the wall of the bag presents free lateral parts 13, separated from the mouth 12 by a line of sealing 15'. As is seen in more detail in FIG. 2, the mouth zone 12 is folded internally so as to form a pocket 120.

Figure 2:
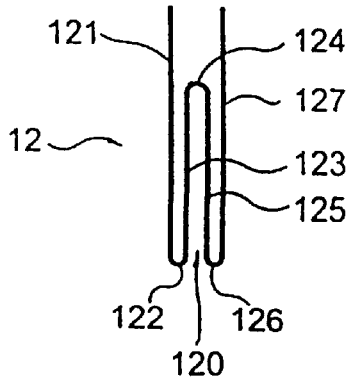
FIG. 2 is a diagrammatic view in cross-section of the mouth of the bag, this view being intended to show how the folded zone which forms the mouth pocket from it is constituted.

On FIG. 2, references 121 and 127 have been used to designate the external surfaces of the wall of the bag and references 123, 125, the interior surfaces of the pocket 120, which are connected to surfaces 121, 127 respectively by 180° folds, 122, 126.

The bottom of the pocket corresponds to a fold with the reference 124.

If the pocket 120 is expanded to shape starting from its initial flat configuration as shown in FIG. 2, to give it a certain volume—as illustrated in FIG. 1—the area of the fold 124 will unfold and stretch to form a flat—or approximately flat—partition 16 which constitutes the bottom of the pocket 120 and separates it from the internal volume of the bag.

In the method of embodiment of the lock chamber illustrated in FIG. 11, which corresponds to a preferred method of embodiment, the lock chamber has a hexagonal outline, with rounded corners, and the configuration of the mouth 12 and the seals 15 is determined in such a way that when the pocket 120 is given the same hexagonal configuration, the partition 16 is more or less flat and level, perpendicular to the longitudinal axis of the bag 1.

Figure 3:
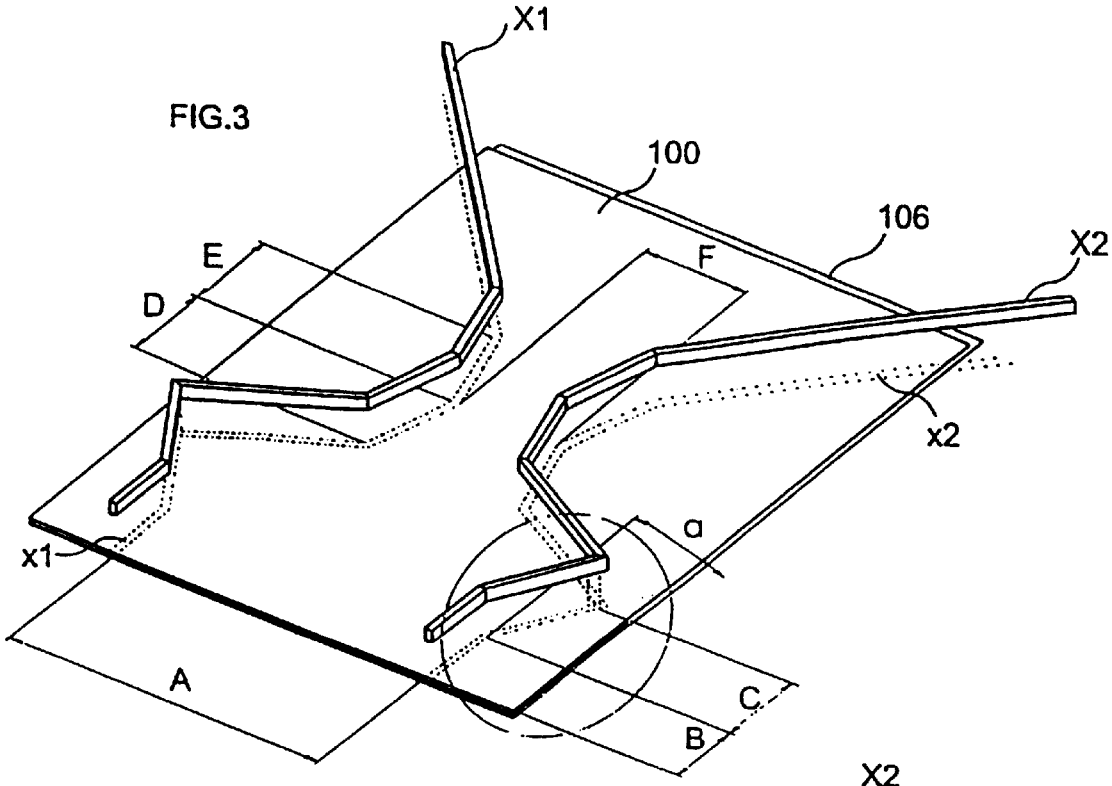
FIG. 3 is a perspective view illustrating the manner in which a plastic sheet intended for making the bag is folded in the mouth area, this view also showing sealing bars and the trace of the seal on the plastic sheet in the mouth area.
Figure 4:
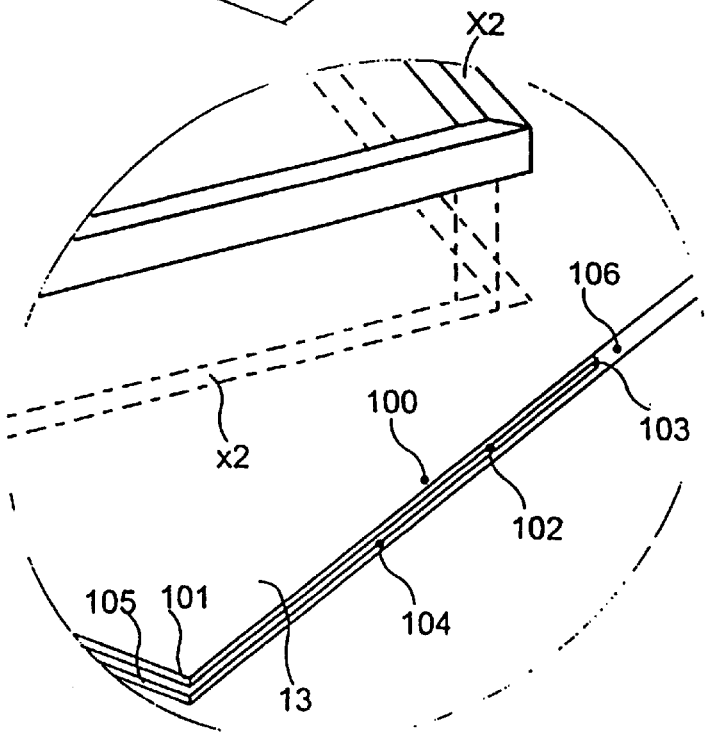
FIG. 4 is an enlarged partial view of FIG. 3, showing the fold.
Figure 5:
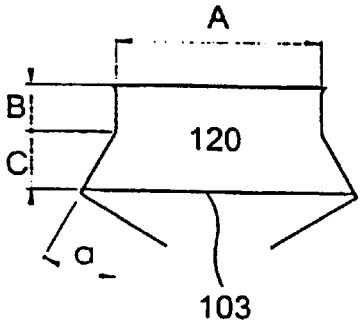
FIG. 5 illustrates the dimensioning of the fold and the shape of the seal in that zone.

These configurations are illustrated in more detail in FIGS. 3 to 5.

In FIG. 3, references $X_1$ and $X_2$ have been used to designate two symmetrical sealing bars, in which the shapes correspond to the outline which is desired for the neck and mouth areas of the bag, by heat-sealing.

Varied fine dashes and the references $x_1$ and $x_2$, have been used to indicate the outline projections of bars $X_1$ and $X_2$, respectively, on the sheath of plastic material from which the bag is to be manufactured, a sheath only partially shown in the diagram. References 100 and 106 have been used to designate the front and rear surfaces of the sheath, references 102 and 104 the surfaces of thearea folded internally (surfaces which correspond—at the pocket—to surfaces 123 and 125 mentioned above).

References 101 and 105 have been used to designate the folds which link surfaces 100 and 102 on the one hand and 104 and 105 on the other, respectively; finally, reference 103 has been used to designate the interior fold (which corresponds to the pocket fold 124 mentioned above).

In place of a sheath, two separate sheets can be used, 100 and 106, parts 102 and 104 being formed by another folded sheet in 103 and sealed in 101 and 105 to sheets 100, 106 respectively.

The width A of the opening of the pocket 120 when this pocket is "flat", naturally depends on the size of the lock chamber, on which the mouth is designed to be mounted.

More precisely, dimension A is nearly equal to the mount gap, close to, or slightly greater than the perimeter of the lock chamber.

Dimension B, which corresponds to the height of the pocket, is a function of the height of the lock chamber and of the dimensions of the gripping system and expansion to volume, located laterally. This area has the function of joining the bag to the lock chamber to prevent the development, on the flat surface of the bottom of the pocket, of constraints which could detach it from the lock chamber and thus break the confinement of the non-sterile area located between the exterior of the bag and the exterior of the lock chamber.

Beyond part B, the wall of the pocket 120 opens out in the direction of the bottom of the pocket 16, by a change in direction at an angle a which is preferably greater than or equal to 30° and is situated at a distance C from the fold 103, short of it, which is equal to approximately $A\sqrt{3}/6$, or about 0.3 times the width of opening A of the flattened pocket.

This configuration means that when the pocket is expanded to volume, to give it a hexagonal shape the bottom of the pocket, initially folded as in line 103, will assume more or less a level and flat form.

Beyond the bottom 16, the seal lines converge strongly, then slightly along a length D then diverging along a length E and finally diverging more strongly towards the sides of the body 10 of the bag.

In this way a narrow area in the shape of a neck is obtained, through which the transfer will be carried out.

For information, dimensions D and E are approximately equal and correspond to the zone which will be threaded into the lock chamber after opening. They vary according to the construction of the lock chamber.

Dimension F, which corresponds to the narrowest passage of the neck, is 1.5 times smaller than the diameter of the passage of the lock chamber door.

Figure 6:
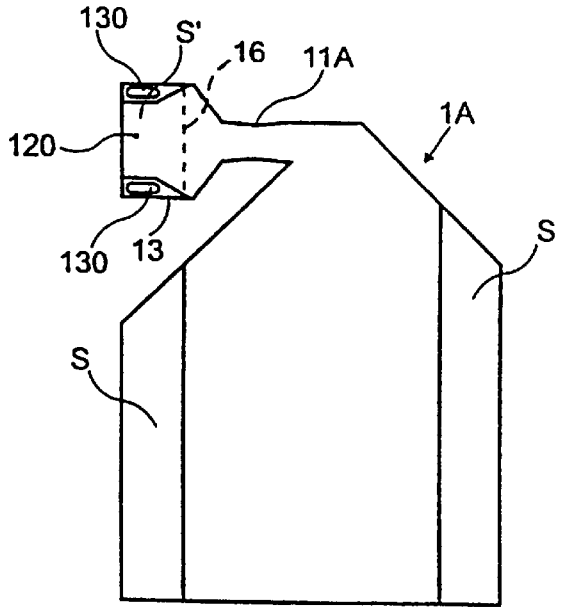
FIGS. 6 to 8 are diagrammatic front views of three methods of possible embodiment of the bag, one provided with a lateral transfer zone, the other with an axial transfer zone and the third having a large capacity, all of these bags being shown empty and flat.

In the bag which is the subject of the method of embodiment in FIG. 6, which carries the reference 1A, the transfer neck 11A is more or less perpendicular to the longitudinal axis of the bag, the pocket 120 opening laterally onto one of the sides of the bag.

Advantageously, this type of bag is constituted from a tubular sheath made of plastic material, in which the two lateral edges are flattened to form gussets S, one of the gussets passing by the mouth to make a gusset S' forming the pocket 120, with bottom 16.

Following peripheral sealing and cutting the shape of bag in FIG. 6 is obtained.

In this method of embodiment, will be noted on each side of the mouth 120, in the external parts 13, elongated openings 130. These are designed to facilitate the gripping of the mouth zone, either manually or by means of mechanical hooking, to facilitate the expansion to shape of the mouth and its adaptation on the lock chamber.

Figure 7:
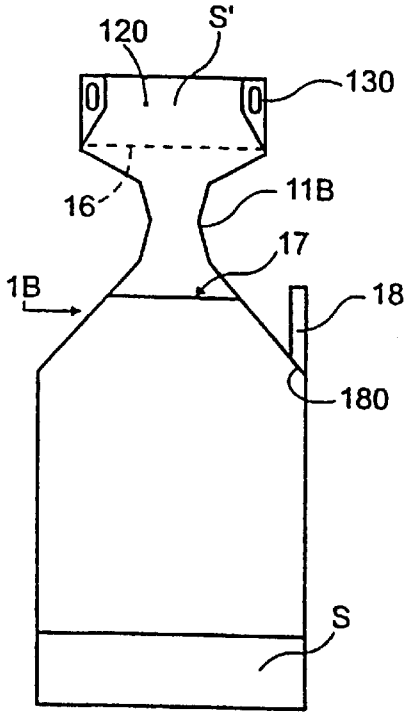

Bag 1B illustrated in FIG. 7 is formed from a folded sheath to form transversal (and not lateral) gussets S and S'.

One of these gussets S' corresponds to the pocket 120, on the sides of which will be noted the presence of openings 130 facilitating gripping, as has just been said in reference to FIG. 6.

It will be noted that bag 1B is equipped with a temporary airtightness or closure system 17, for example adhesive or with a slide, the function of which is to isolate at will the head of the bag from its contents. Thus, it is possible to transfer liquids or powders easily, but also to protect the contents from any contamination generated during the operations of connection or cutting.

It will also be noted that bag 1B is fitted with an appendage 18.

This is a tubular inflation appendage, which enables the pre-inflation of the bag. As soon as the pre-inflation is completed, the area which has been used for injecting the pre-inflation gas is reclosed by a seal line 180.

Figure 8:
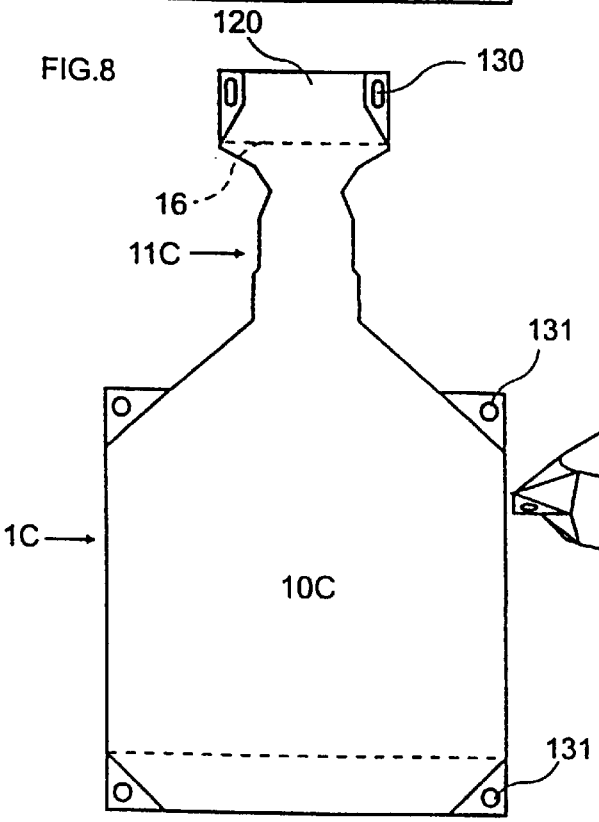

Bag 1C, shown empty in FIG. 8, is a large capacity bag. The body 10C of the bag has a generally rectangular or square shape and its corners, exterior to the main body, contain holes 131, designed to facilitate the handling and the stacking of the bags after they have been filled.

Figure 9:
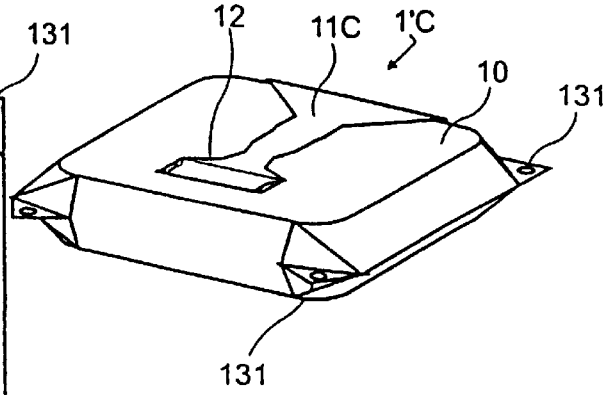
FIG. 9 is a perspective view of the bag in FIG. 8, shown filled.

FIG. 9 shows such a bag, with the reference 1'C, in which the neck 11C and the mouth 12 have been folded flat against one side of the bag.

FIG. 10 shows the hexagonal shape of the pocket 120 when it is expanded to volume; the fold line 124', shown in broken lines, is no longer visible—or nearly no longer visible—due to the tensioning of the bottom of the bag, which takes the form of a level or more or less level partition.

As will be seen below, it is this partition which will be cut to enable the transfer of the products or articles contained in the bags into the sterile enclosure.

In the event that the interior of the bag is under vacuum, or at low pressure, the pre-inflation mentioned above is required to enable flattening of the partition which constitutes the bottom of the bag.

The lock chamber shown in FIG. 11 essentially comprises an exterior part 2, fixed, and an interior, mobile, part—or door—4.

Part 2 has the overall form of a generally tubular sleeve, with an axis kk', composed of a circular base 20 and a hexagonal head 21.

The base 20 is designed to be fixed by appropriate means, in an airtight fashion, onto the entry opening of a sterile enclosure.

Figure 14:
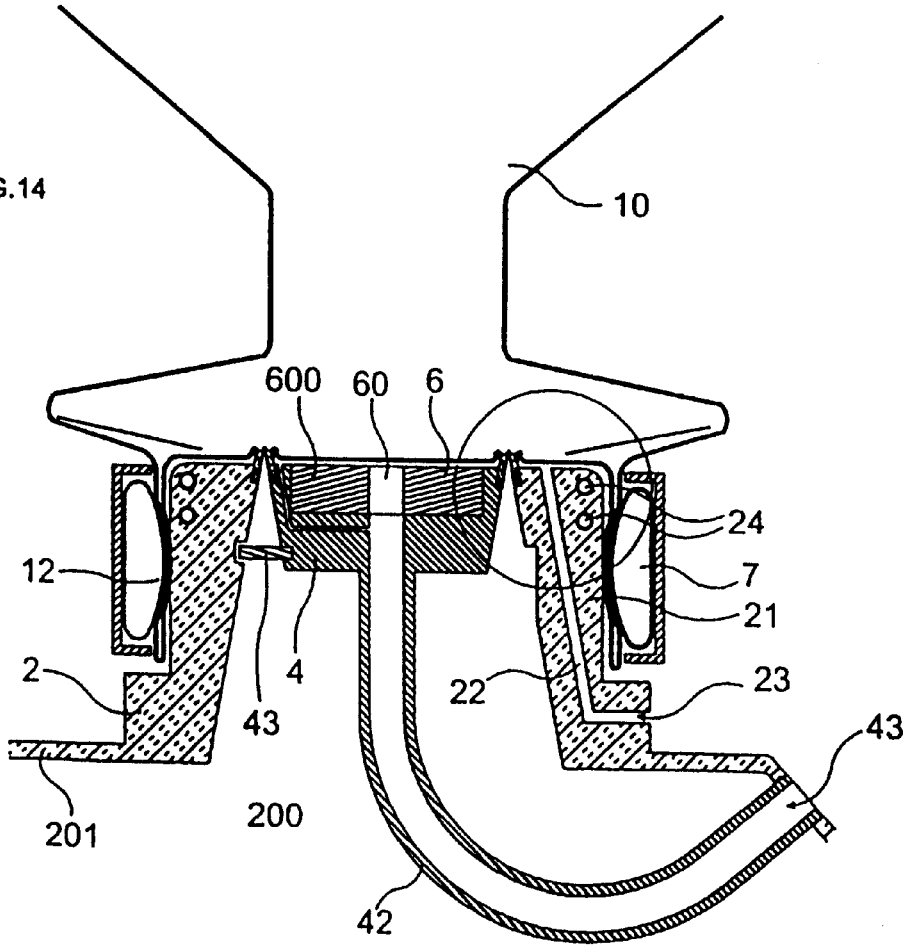
FIG. 14 is a similar view to FIG. 12, showing the system following cutting of the bag but before transfer.
Figure 16:
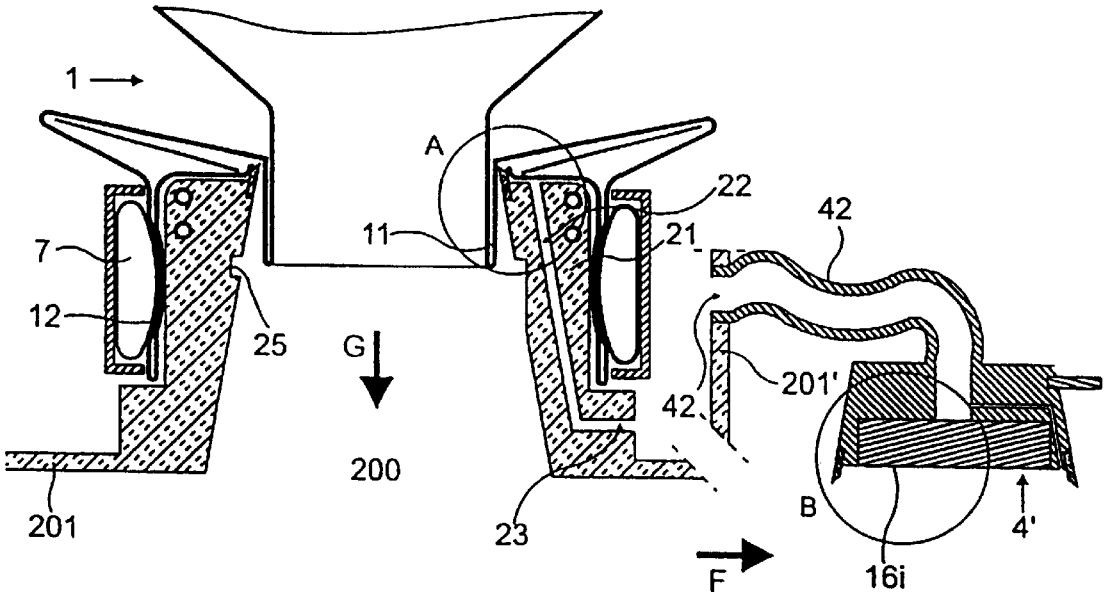
FIG. 16 is a similar view to FIGS. 12 and 14 following cutting of the bag, the door of the lock chamber being open and the bag transfer zone turned over, with a view to the transfer of the products from the bag to the sterile enclosure.

In FIGS. 14 and 16, the reference 201 has been given to the wall of the enclosure and the reference 200 to its interior, sterile space; with the aim of simplification, the base 2 has been shown as forming an integral part of the wall 201.

In FIG. 11, 210 has been used to designate the lateral sides of the hexagonal part 21, and reference 211 its frontal, flat side, which is perpendicular to the axis kk' of the sleeve 2.

The mobile lock chamber element 4 has the general form of a disc, which can move axially in the interior of the fixed part 21, to retract into the enclosure 200 when the lock chamber is open.

In contrast, when the lock chamber is closed, its frontal face 40 is found more or less in the same plane as face 211.

A discoid telescopic piston 6 can also slide within the interior of part 4, coaxial to part 4.

Figure 15:
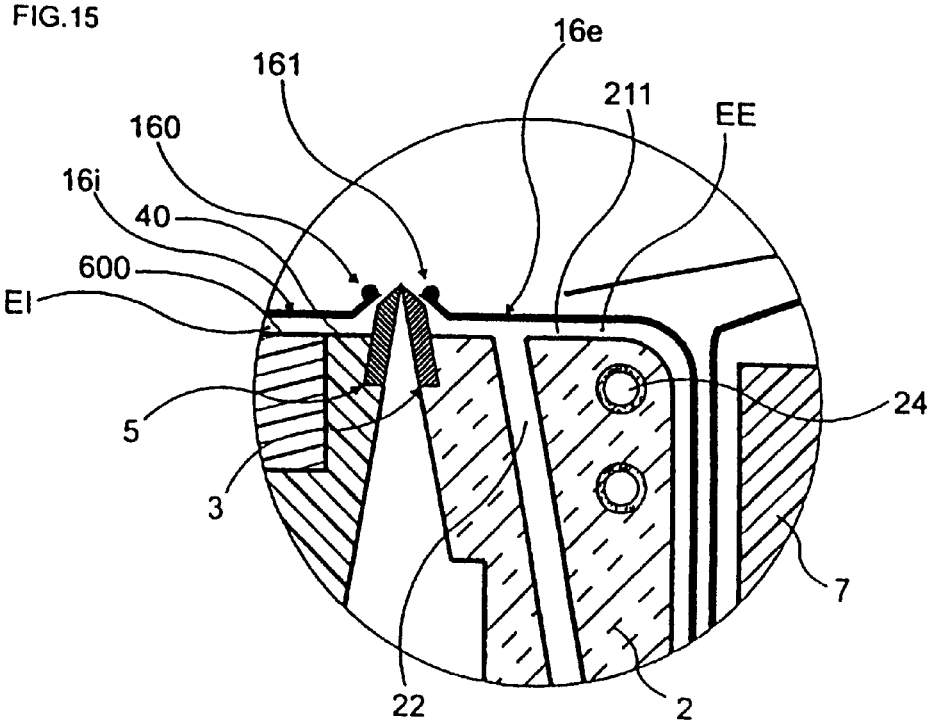
FIG. 15 is an enlarged view of FIG. 14 in the area of the cutting blades.
Figure 18:
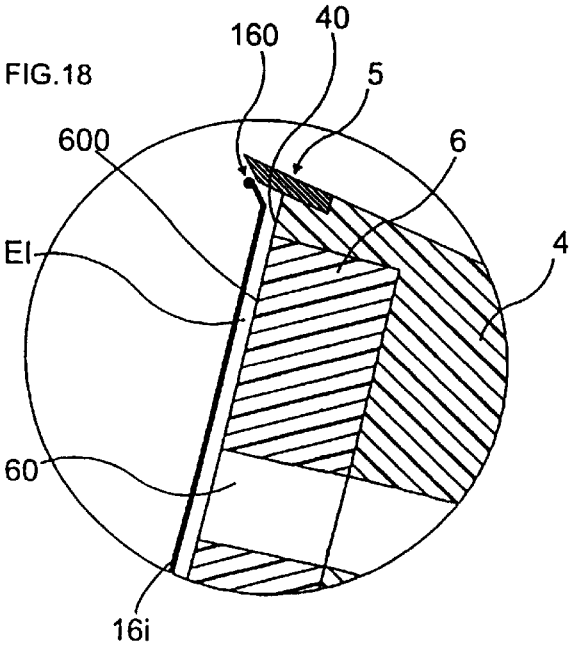

In a retracted position in the interior of part 4, the frontal face 600 of the piston 6 is located in the same plane as the above-mentioned face 40 (see FIGS. 14, 15 and 18). In contrast, in another position (see FIGS. 12 and 13) the face 600 of the piston projects in relation to the face 40.

The piston 6 is pierced by an axial bore 60 which opens into a bore coaxial to the part 4 and is connected to a pipe 42 in which the end 43 is connected to a vacuum outlet, via an appropriate control valve.

Figure 12:
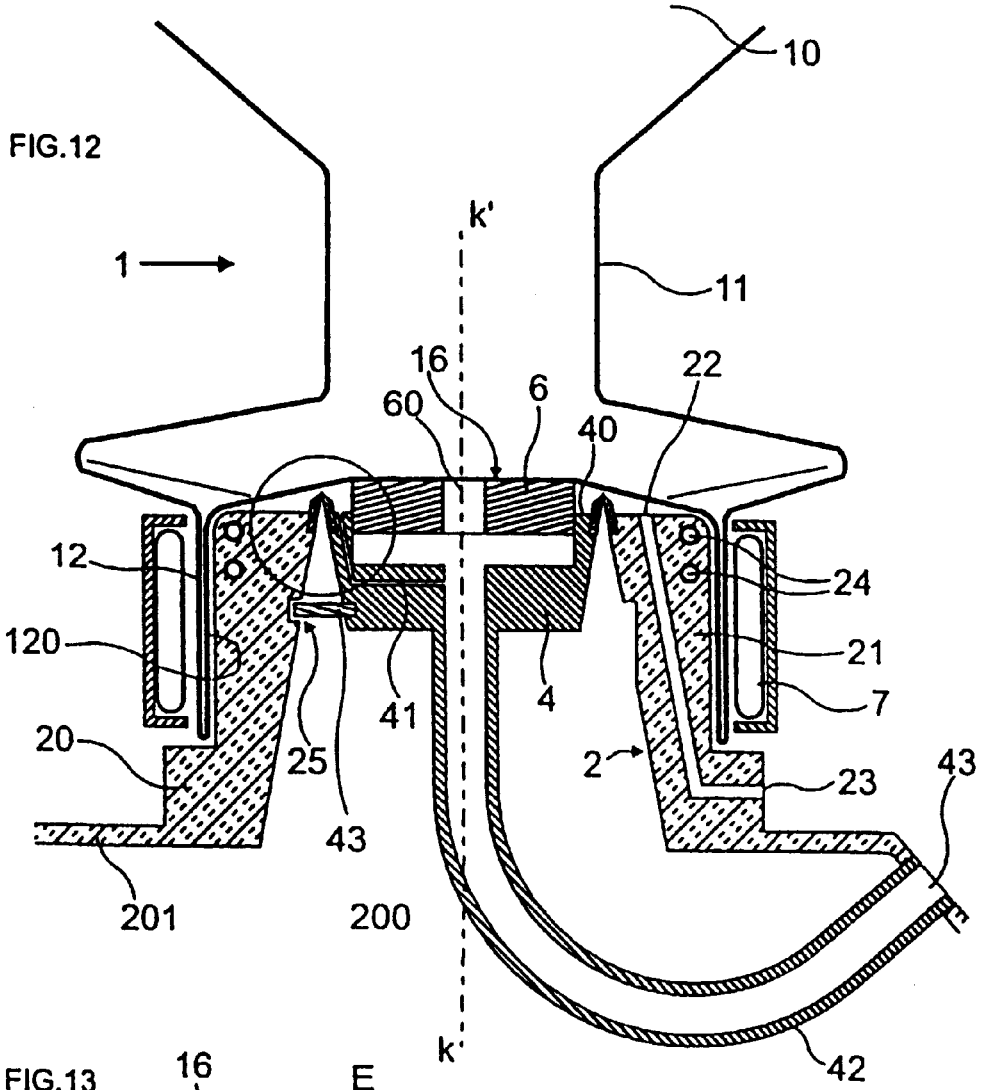
FIG. 12 is a diagrammatic view in cross-section which shows the bag mounted on the lock chamber, before the transfer operation.
Figure 13:
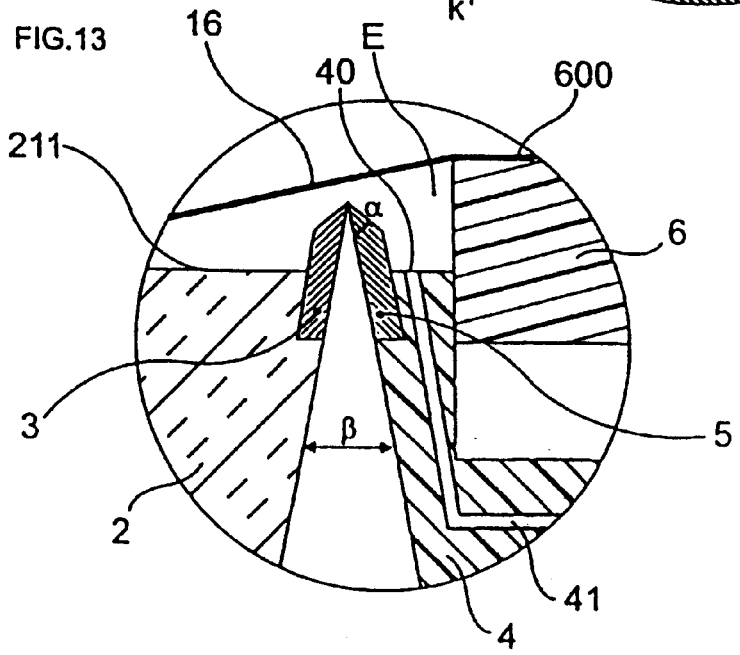
FIG. 13 is an enlarged partial view of FIG. 12 in the area of the cutting blades.

This pipe 42 also communicates, via channels 41, of which only one is shown in FIGS. 12 and 13, with the frontal ring surface 40 of the part 4, located to the exterior of the piston 6.

In a similar fashion, channels 22 drilled in the fixed part 20 of the lock chamber, of which only one is illustrated in the drawings, open onto the frontal surface 211 of the fixed part 21 their end 23 is connected to a vacuum outlet, via a control valve.

Parts 2 and 4 are each equipped with a heatable cutting blade with closed outline, this outline being in circular form in the method of embodiment illustrated.

As will be seen in more detail in FIG. 13, these blades have bevelled cutting edges and come into mutual contact at their tip. The angle $\alpha$ is of the order of 20 to 30°.

The exterior blade, integral to part 2, carries the reference 3; the interior blade, integral to part 4, carries the reference 5.

The interior opening of part 2 has a slightly flattened cone shape, with its top angle pointing towards the exterior of the enclosure. The lateral wall of part 4 also has a flattened cone shape, but arranged inversely (top angle pointing towards the interior of the enclosure 200).

The blades 3 and 5 are located in the extension of the above-mentioned walls and are applied against each other lightly by force, which implies their elastic deformation, of low magnitude; this "tight" diametral contact ensures airtightness at the line of closed contact between the two blades.

For information, the angle $\beta$ (see FIG. 13) formed by the dorsal faces of blades 3, 5 is of the order of 20°.

The set of blades 3, 5 projects slightly in relation to surfaces 211, 40 mentioned above, when the door occupies its closed position illustrated in FIGS. 12 and 13.

In the method of embodiment illustrated in FIGS. 12 to 21, the axis of the entry opening of the enclosure and correlatively the axis kk' are vertical, the blades 3, 5 being turned upwards.

Appropriate means of fixation enable the maintenance of the door 4 in its closed position.

In the example illustrated, these means are of the type using rapid connection by partial turn, comprising peripheral lugs integral to part 4, capable of engaging and locking into a groove 25 fitted into the interior wall of part 2.

Appropriate means, not shown, are provided which enable the door 4 to be unlocked and to be retracted into the interior of the enclosure, as is illustrated diagrammatically in FIG. 16.

This implies, of course, that the pipe 42 is flexible.

On the assumption that the interior of the sterile enclosure is accessible to the gloved hand of an operator, the manoeuvring of the door can be done manually. The blades 3 and 5 are metal, and are designed to be heated by induction, by means of one or several coils 24 through which a high frequency alternating current is run.

Depending on the dimensions of the aperture of the lock chamber passage or on other parameters affecting the efficiency of the heating of the blades, the high frequency induction coil(s) can be placed either in the fixed part 2 or in the mobile part 4.

In the example illustrated, the coils 24 are housed in part 2.

The constituent materials of parts 2 and 4 are of course amagnetic insulating materials, resistant to high temperatures.

This means, for example, a composite material based on cotton and bakelite; preferably between the blades and their holder a layer of PTFE (polytetrafluorethylene) is allowed for.

The heating system is preferably selected so as to ensure a heating temperature of the blades to 200° C.

On the exterior of the fixed head 21 there is an inflatable ring collar 7.

The dimensions of the bags and the lock chamber will of course be selected according to the products or articles which are to be contained in the bags then transferred into the sterile enclosure.

For information, a bag could have an overall length of 800 mm and a width of 400 mm, while the diameter of the door 4 of the lock chamber would be of the order of 80 mm.

By referring to FIGS. 12 to 18 we are now going to describe in what manner the transfer is carried out of products or articles contained in a bag 1, previously sterilised, into the interior of a sterile enclosure 200.

Initially, the door 4 of the lock chamber is closed, the closure systems 43, 25 being in door-locked position, the position illustrated in FIG. 12.

In standard form, there is a slight overpressure in the interior of the sterile enclosure 200, for example of the order of 60 Pascal, in relation to atmospheric pressure, which prevents the unexpected entry of outside air, liable to contain particles or micro-organisms, notably through the contact zone between the two blades 3 and 5.

The bag has been mounted from top to bottom onto the hexagonal part 21 of the lock chamber, inside the sleeve 7 after which this is inflated, in order to ensure the retention of the pocket on the lock chamber.

Air under pressure is also introduced into the pipe 42, so as to make the piston 6 move up into the position illustrated in FIGS. 12 and 13, which has the effect of tensioning the partition 16 ensuring that this is distanced from the set of blades 3 and 5.

As already said, if necessary, a pre-inflation of the bag by sterile atmosphere is carried out to enable the separation of the bottom of the pocket from the surfaces which were stuck to this bottom (adjacent surfaces).

The electrical supply to the coils 24 is then switched on, which has the effect of heating the two blades 3 and 5 by induction.

These are taken up to the required temperature, for example of the order of 200° C., for a few minutes, enough to sterilise the blades; then the temperature is allowed to drop towards 120° C., to cut the plastic material of the partition 16 by fusion, the pipe 42 is connected to a vacuum pump by the opening of an appropriate valve, not shown.

In the same way, the channels 22 are connected to a vacuum outlet,

For information, the pressure (negative) of this placing under vacuum is of the order of $2.10^4$ Pascal.

In this way the piston 6 is caused to move downwards and its retraction in the door 4 is also initiated, while sucking, the partition 16 downwards and applying it against the set of circular blades 3, 5.

As a result of this operation, the non-sterile air found outside the lock chamber and outside the bag, on the one hand in the interior space E1 in relation to the door 4 and on the other hand in the exterior space EE, is eliminated.

The vacuum combined with the fusion of the plastic will cut the partition and, on each side of the blades, will create an airtight contact between each cut part of the partition 16 and the corresponding part of the lock chamber.

These airtight contacts enclose the non-sterile areas.

As illustrated in FIGS. 14 and 15, as a result of the fusion of the plastic material, the contact of the material with the blades is effected using strips which provide a total or virtually total airtightness at that point.

In FIG. 15, references 160 and 161 have been used to designate the circular strips which border the cut interior part **16*i* and the cut exterior part 16*e***, respectively, of the bottom of the pocket.

In practice, the cut parts of the partition, **16*i* and 16*e*, have just been applied against the fixed surfaces 600 and 40 on the one hand and 211** on the other; however, in order to improve the clarity of the drawings, a slight gap has been preserved in the figures in these areas.

By comparing FIGS. 13 and 15, it will be understood that only the exterior cutting parts of the blades (located between the strips 160 and 161) are now located inside the bag, that is in a sterile zone, though they were initially exposed to a non-sterile atmosphere.

However, as a result of the heat sterilisation of the blades at a high temperature, and due to the fact that the cutting parts of the blades have been subject to wiping by the plastic material in fusion during cutting, any bacteria or micro-organisms which might have been found on these surfaces have been eliminated.

Of course, this guarantee of sterility cannot be met if, after cutting, the plastic remains in contact with the cutting blade, the blade must therefore be composed of a sharp zone for cutting and of a holding zone for after cutting, which is the case with the configuration of blades illustrated in the drawings.

Naturally, the vacuum continues to be applied in the pipe 42 and in the channel 22, so as to press the strips 160,161 against the corresponding blades 5 and 3.

Following cooling of the set of blades 3, 5, one proceeds to the opening of the lock chamber. To do this, the door is unlocked, by disengaging parts 43 and 25 and the mobile part 4 inside the sterile enclosure 200 is brought down, as illustrated in FIG. 16.

To improve the legibility of this figure, one part of the wall of the enclosure has been artificially turned back at a right angle, with the reference 201', into which the pipe 42 is fitted.

The discoid part of the partition **16*i* remains stuck through suction against the retracted door, which has the reference 4**', inside the sterile enclosure.

This is not a problem, insofar as it is the sterile surface of part **16*i*—a surface which was inside the bag before cutting—which is exposed to the sterile environment of the enclosure. In contrast, the contaminated air located on the other side of the plastic disc 16*i* is confined in the space EI, in an airtight manner, as a result of the presence of the ring strip 160 and the maintenance of the vacuum in part 4**.

Figure 17:
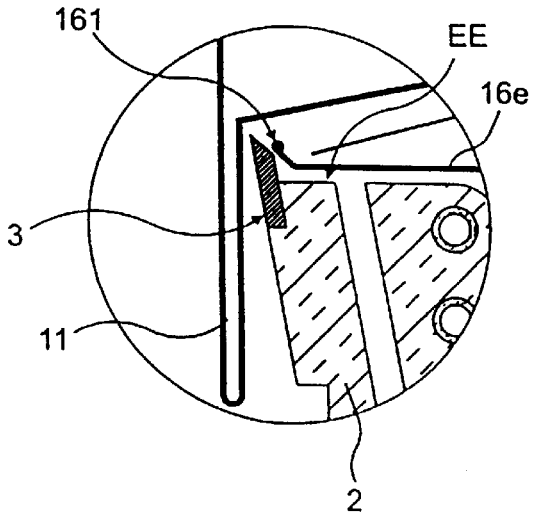
FIGS. 17 and 18 are enlarged partial views of FIG. 16, in the area of the exterior blade and of the area of the interior cutting blade respectively.

In view of the transfer of products from the bag 1 into the sterile enclosure 200, the neck of the bag 11 is threaded and turned over (in the same way as a sock) in the opening of the lock chamber, as is illustrated in FIGS. 16 and 17. This has the effect of protecting the bag's contents from contact with the exterior blade 3 and preventing damage to or contamination of the contents by the blade.

It will be noted that only the sterile surface of the neck 11 (the side which was located inside the bag) will partially enter the interior of the enclosure 200.

The transfer of the products from the inside of the bag into the enclosure can then be effected, as is symbolised by the arrow G in FIG. 16.

Once the operation is completed, the door is reclosed, to return to the position illustrated in FIG. 12, then locked.

The vacuum sources are then disconnected from the pipe 42 and the channels 22, by activating the valves provided, and the clamping sleeve 7 is deflated.

The empty bag 1 is then removed and—in the same way—the exterior cut part 16*e* (which is attached to it), after which the plastic disc 16*i* is removed.

The lock chamber is now ready for a new, similar operation on a new bag.

Naturally, following cutting and before transfer, the door is only opened once the blades have been correctly cooled.

To limit the waiting time, it is advantageous to provide a cooling system for the blades, for example by circulating a cooling fluid in the interior of parts 2 and/or 4.

Figure 19:
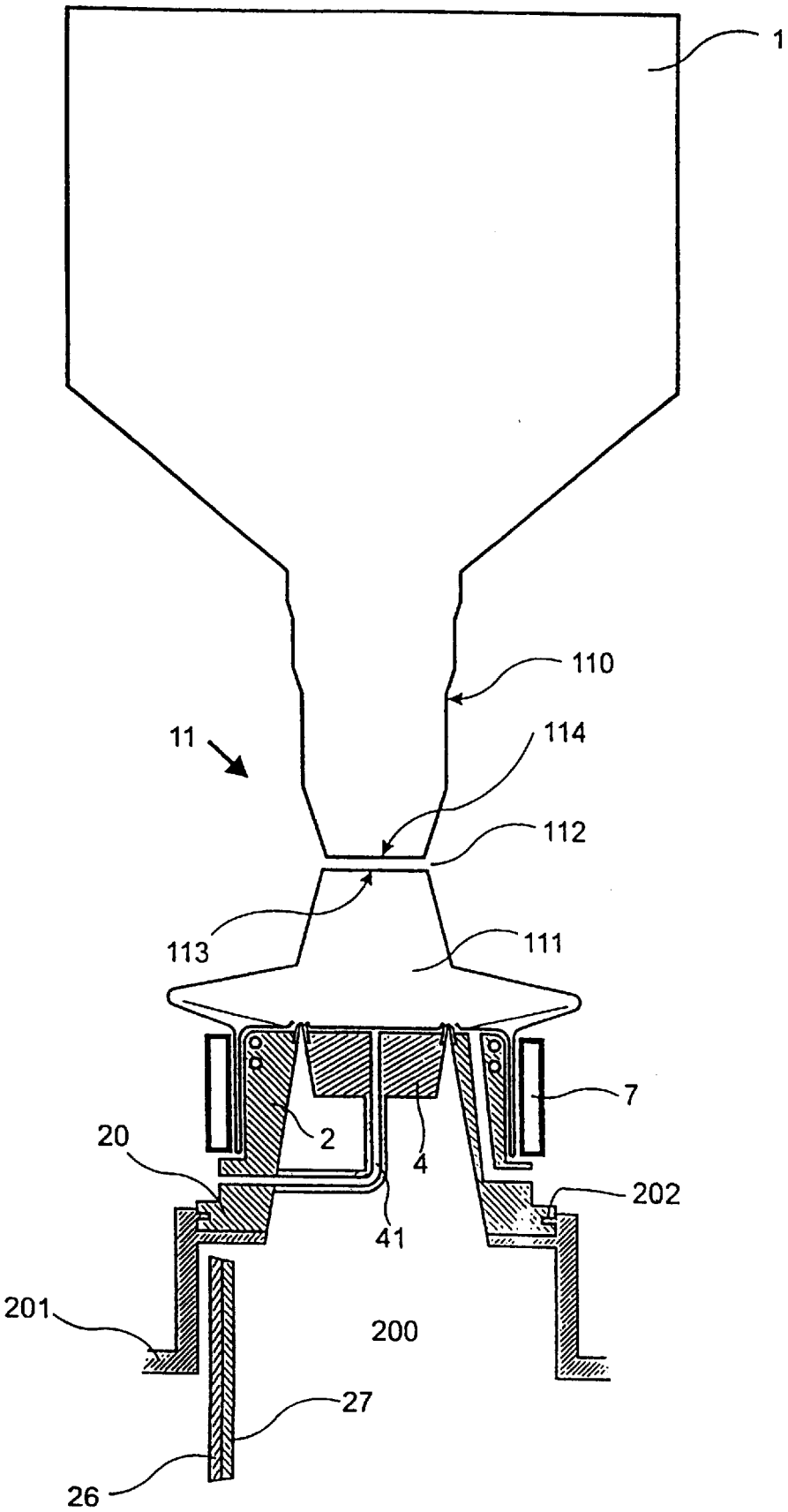
FIG. 19 shows, diagrammatically and in cross section, a transfer system in which the lock chamber is removable, the lock chamber being shown on an airtight door collar, the bag being reclosed by an additional seal isolating the sterile contents.
Figure 20:
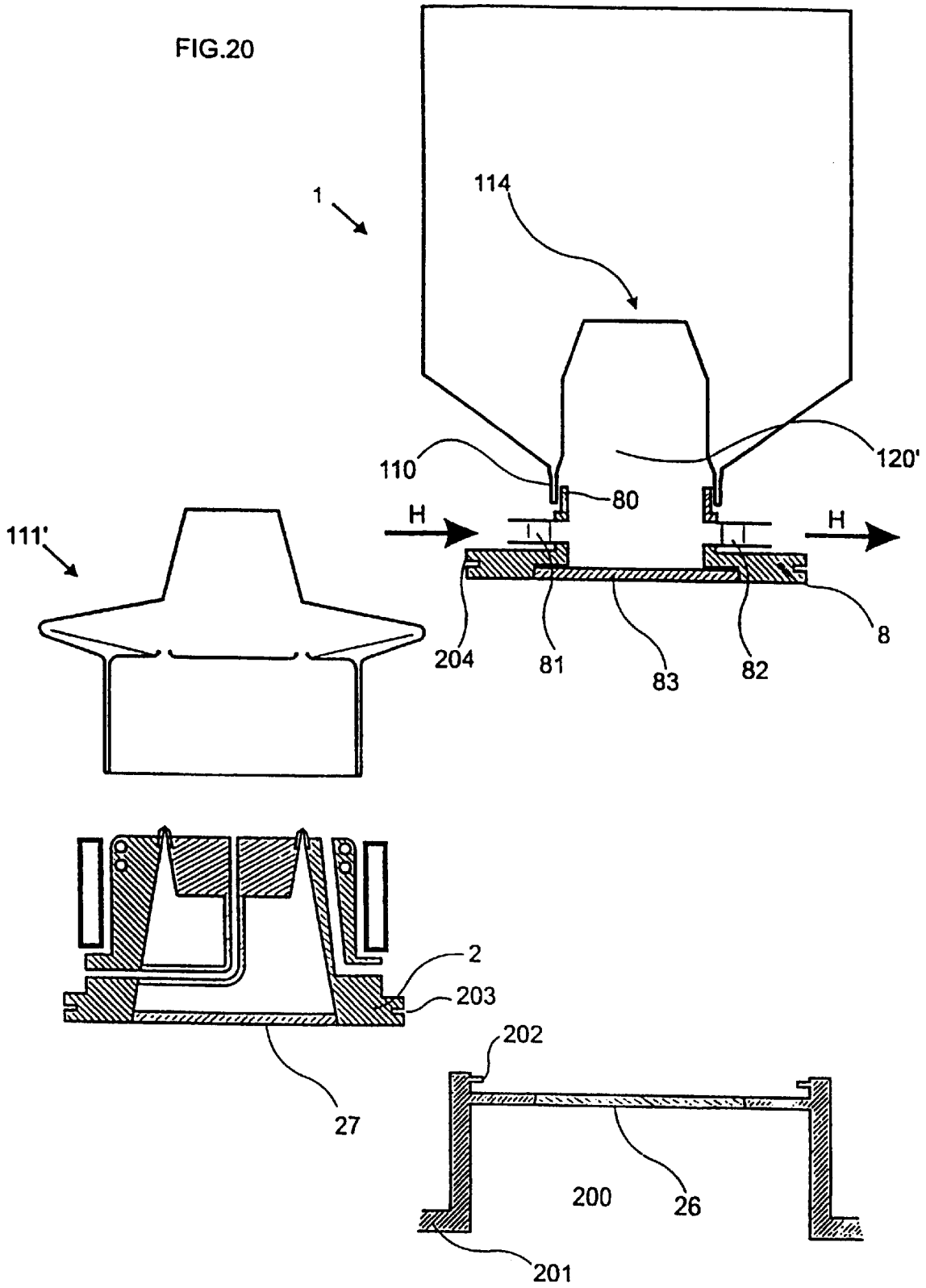
FIG. 20 is a similar view to FIG. 19, which shows the sterile enclosure reclosed by its airtight door, the lock chamber reclosed and disconnected, the transfer pocket separated, the rest of the bag being mounted on an airtight door collar.
Figure 21:
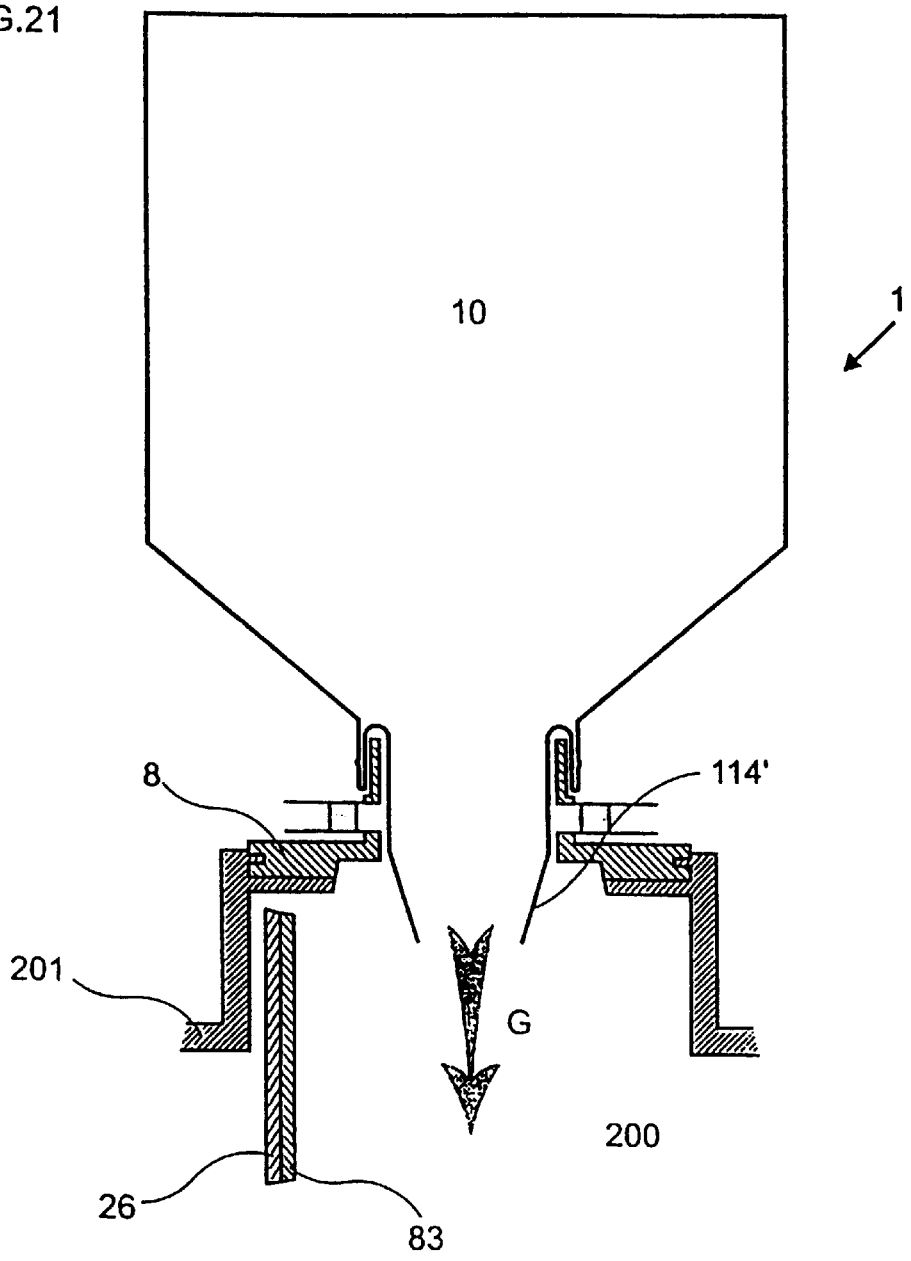
FIG. 21 is a similar view, showing the bag equipped with its airtight door reconnected to the sterile enclosure.

In the method of embodiment of the system illustrated in FIGS. 19 to 21, a lock chamber has to be dealt with which is mounted in a removable fashion on the wall 201 of the sterile enclosure 200.

The wall of the enclosure and the base 20 of the part 2 of the lock chamber have supplementary means of fixing 202, 203, for example using a bayonet or a partial turn.

The situation illustrated in FIG. 19 corresponds to an incomplete emptying of the bag 1, in which only some of the products have been transferred into the enclosure 200, by implementing the method described above.

At this point, a cessation of distribution is required and the products which have not been transferred must be maintained in the interior of the bag in a sterile atmosphere.

To do this, the door 4 has been reclosed, and heat-cutting is carried out, with sealing of the two edges of the cut, in the median part of the transfer zone 11.

The line of cut 112 separates two partitions 113, 114, the first integral to the mouth zone 111 and the second integral to the part 110, attached to the bag 1.

During this cutting—sealing operation, the sterility of the interior of the bag has not been tainted.

The enclosure is fitted with a double door 26, 27 which is reclosed, the door 26 closing the entrance of the enclosure, while the door 27 closes the exit from the lock chamber.

The lock chamber is removed with the mouth of the cut bag, which carries reference 111' (cf. FIG. 20).

The remaining part of the bag 1 is then adapted to an airtight door collar 8, this adaptation being achieved using the part of the neck 110 previously turned over.

The door collar 8 possesses a peripheral locking groove 204 similar to the groove 203 on the lock chamber so that it can be adapted to the locking elements 202 of the enclosure and be fixed in an airtight manner to it.

The collar 8 is closed in an airtight manner by a door 83.

The turned back neck 110 having been fixed to a ring piece 80 integral to the collar 8, a new pocket with bottom 114 is obtained, in which the interior space 120' is not sterile.

In a known manner, the door collar 8 contains entry 81 and exit 82 openings which are equipped with filters or valves isolating them from the exterior and which enable the circulation—symbolised by the arrows H—of a gas or vapour capable of sterilising the interior of the pocket 120'.

When sterilisation is complete, the bag is equipped with the double door transfer system and will thus be able to be re-used.

To do this, the collar 8 and the bag 1 are fitted onto the entrance to the enclosure 200 and the doors 26, 83 are opened after which the partition 114 is broken to enable penetration into the interior of the opening of the enclosure to form a funnel 114'.

The rest of the products contained in the bag can then be transferred into the sterile enclosure, as symbolised by the arrow G.

Figure 22:
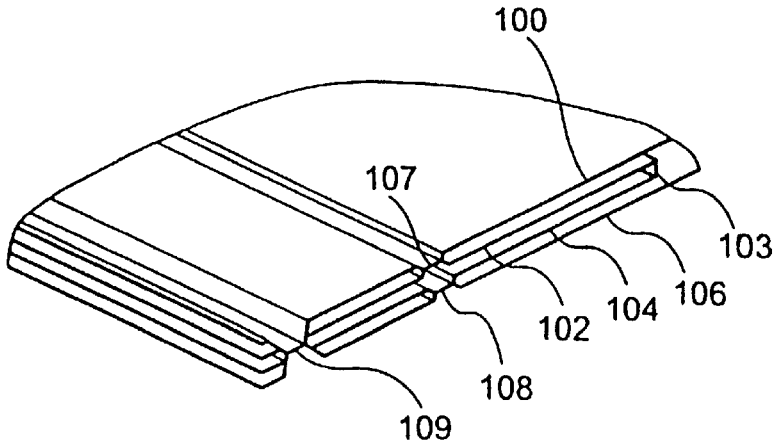
FIG. 22 is a partial diagrammatic view, in perspective, which shows a variant of the transfer pocket which is fitted with additional protective seals.

The layout illustrated in FIG. 22 has the aim of protecting the interior of the bag's transfer pocket from contamination during transport.

In this figure, the same references as in FIG. 4 have been used to designate the various folds in the plastic sheet at the mouth.

The walls 100 and 102 on the one hand, and 104 and 106 on the other are joined to each other by seal lines 107, 108 respectively.

At the edge of the pocket these two assemblies are also joined by a seal line 109.

These various seals keep the different surfaces of the walls away from the exterior air.

The protective seal 109 will be cut just before the connection of the pocket to the lock chamber in readiness for the transfer.

Naturally, it would be possible to allow for other methods of protection, notably by using an adhesive strip which closes the pocket or by an overwrapping bag.

Figure 23:
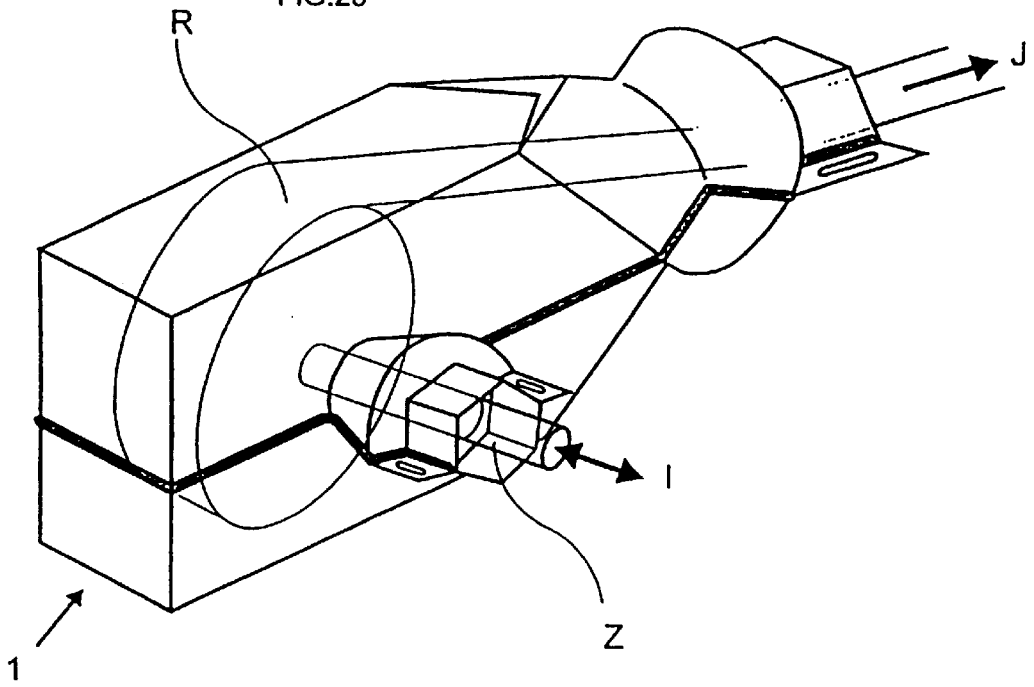
FIG. 23 shows diagrammatically, in perspective, a variant of the bag, equipped with two transfer pockets and used for emptying a material in sheet form.

The method of embodiment of the bag illustrated in FIG. 23 is intended to receive a roll R of material in sheet form. As the roll is emptied, the transfer of the sheet, symbolised by the arrow J, into the sterile enclosure is carried out in a similar fashion to that pertaining to individual articles or loose products.

It will be noted that the bag contains an additional, lateral pocket into which it is possible to introduce and withdraw mechanical equipment Z for emptying the roller, as symbolised by the double arrow I.

The roller R could also, of course, carry materials in thread or tube form.

Figure 24:
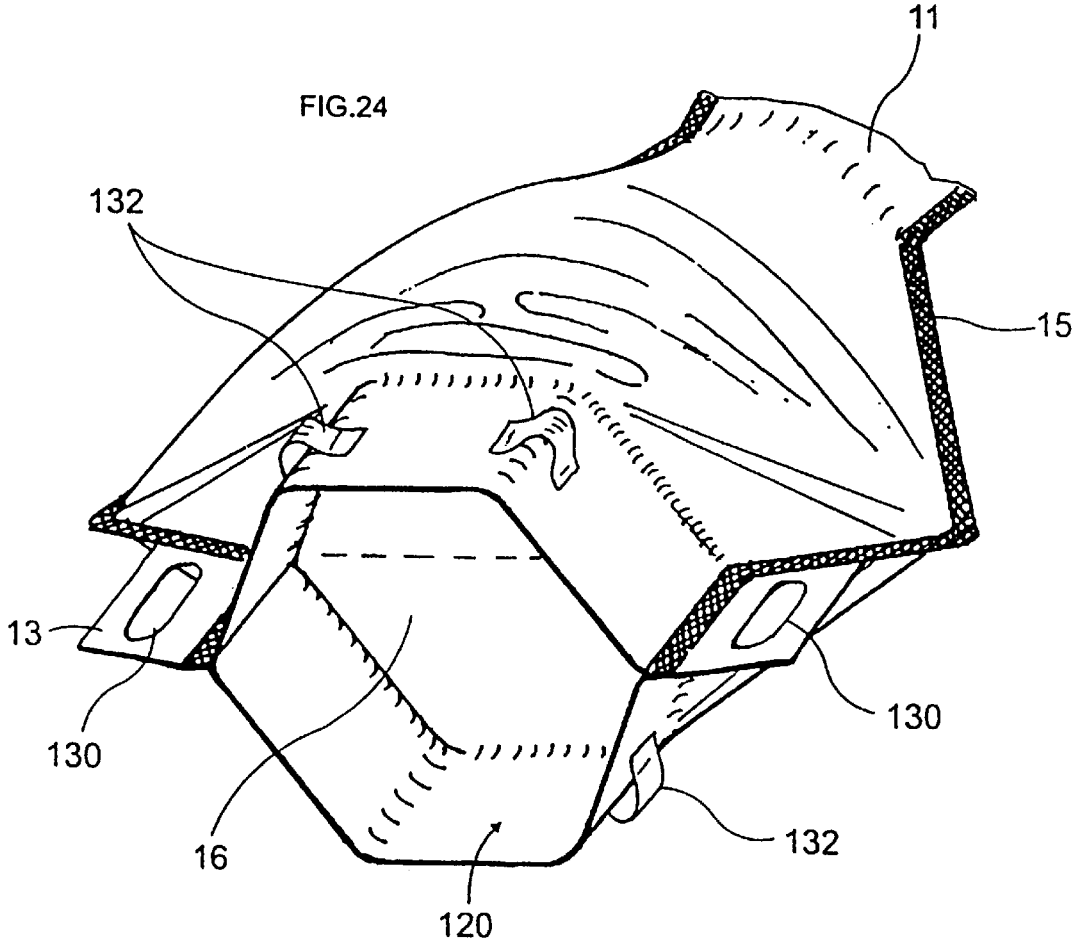
FIG. 24 shows, in perspective, the mouth zone of the bag, following the expansion to volume of the pocket in hexagonal form, this variant of the bag being equipped with means of gripping and of assistance for the expansion to volume.

In the variant illustrated in FIG. 24, the external face of the pocket 120 is equipped with a series of fittings to enable gripping 132. These are small bands of plastic material which are sealed around the mouth in such a way as to make small hoops, at four of the corners of the hexagon obtained when the pocket is expanded to shape.

Means of expanding the pocket to shape can be provided which have hook fittings which act with the bands 132 and possibly with the elongated holes 130, to give volume to the pocket and fit it onto the lock chamber.

Figure 25:
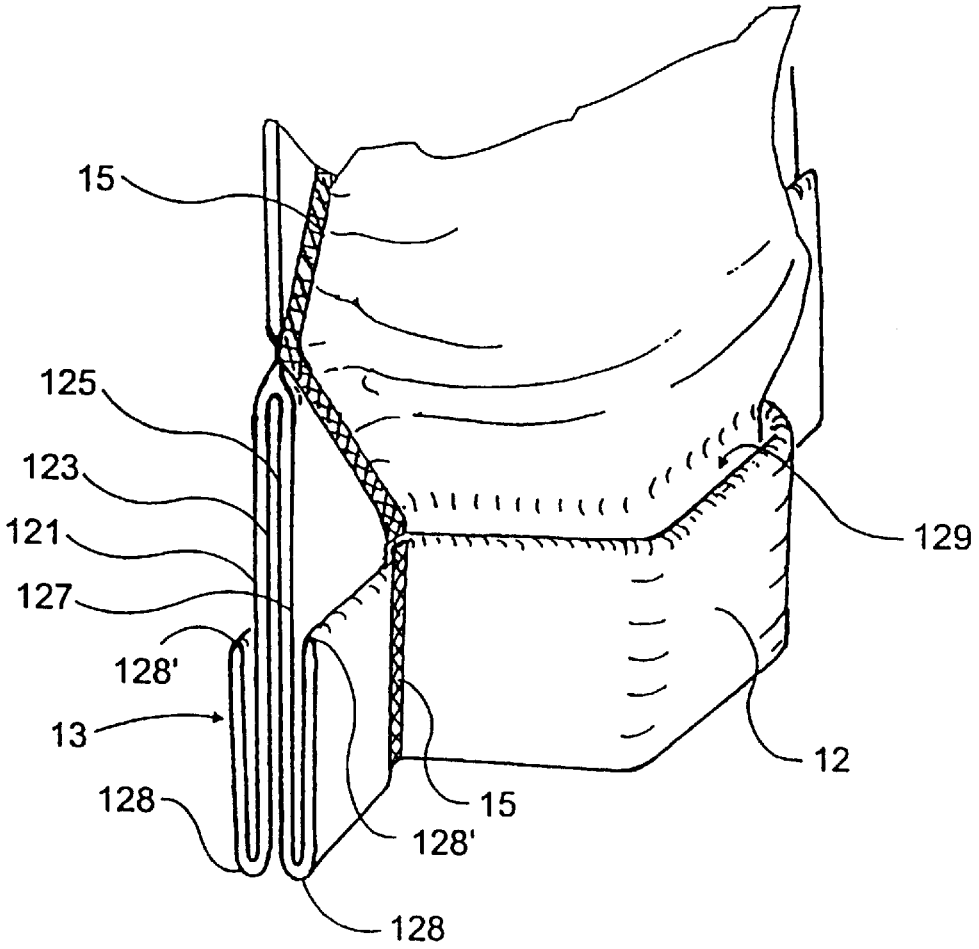
FIG. 25 is a partial view of a variant of the bag, from its mouth which is folded double so as to form a peripheral groove capable of receiving by interlocking an element for expanding to shape and rigidifying the pocket.

In the variant illustrated in FIG. 25, the same references have been used to designate the different folds in the sheet around the mouth as in FIG. 2.

It should be noted that the two parts 121, 123 on the one hand and 125, 127 on the other are both folded towards the exterior at 180°, forming folds 128.

Figure 26:
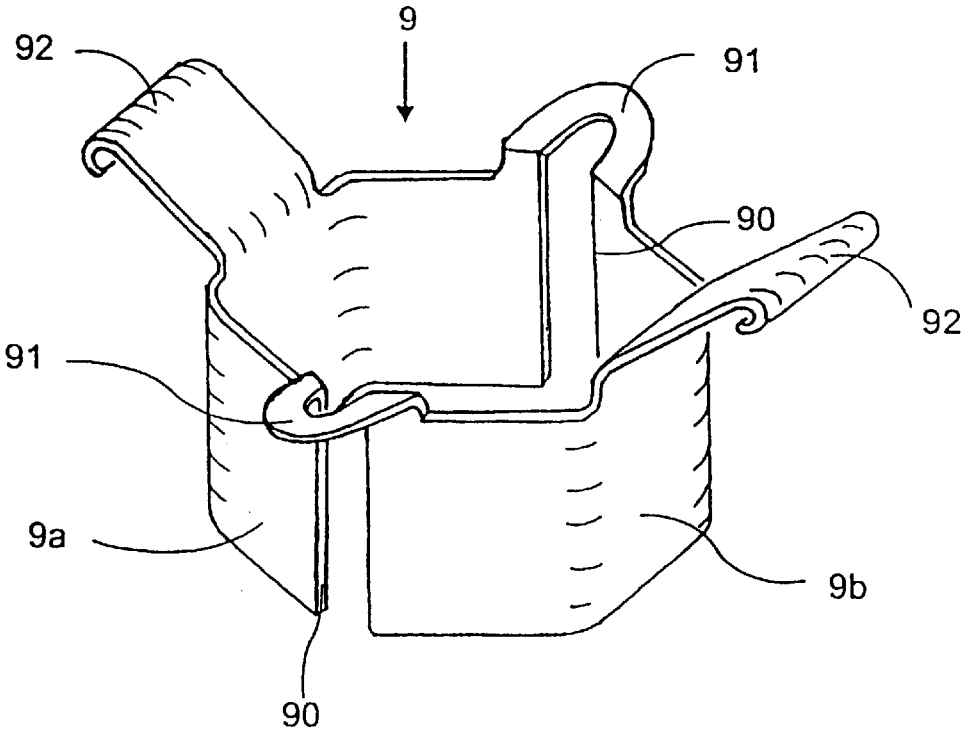
FIG. 26 is a perspective view of this rigidifying element.

The raised exterior folds, designated 128', thus form a peripheral groove 129 which is capable of receiving, by interlocking an element for the expansion to shape and rigidification of the pocket; this element is designated by the reference 9 and is shown in FIG. 26.

The element 9 is of a rigid material, for example metal or plastic material.

It has the general shape of a hexagonal sleeve, composed of two half-shells 9*a*, 9*b*, separated by longitudinal slits 90 but joined by a pair of ears 91 placed at the top end of the slits.

Each half-shell 9*a*, 9*b*, carries on its upper part a handle 92 which extends outwards, in an oblique direction and jutting out at an angle of 90° in relation to the ears 91.

The element 9 is shaped in such a way that it is possible, by manipulating it with the handles 92, to pass it onto the mouth of the bag, then (by moving in the opposite direction)

to introduce it into the interior of the peripheral groove 129 mentioned above, which ensures the expansion to shape and the rigidification of the pocket 120.

The presence of the slits 90 and the ears 91 is designed to enable the passage of the elements 9 onto the free edges 13 of the mouth of the bag when the element is put in position.

In the preceding description, the bag used is entirely composed of flexible plastic material, which is relevant in terms of the manufacturing cost of the bag and its compactness when empty.

It goes without saying that it would not be departing from the framework of the invention to allow for a container-type bag composed of a rigid body with a pocket-shaped mouth; it is only important that the bottom of the pocket should constitute a flexible partition capable of being heat-cut by the blades.

The exterior wall of the lock chamber could be of a different shape from a hexagonal one, notably a square, rectangular or circular shape.

The hexagonal shape is useful for a flexible pocket, initially flat, as it enables the proper levelling of the partition at the bottom of the pocket at expansion to volume; in addition, this shape is similar to the circular shape of the blades and enables a good level of airtightness between the bag and the lock chamber.

Instead of heating the cutting blades by induction, heating elements with low thermic inertia could be used; this solution is applicable in particular for lock chambers with large diameters.

The retention of the pocket on the fixed part of the lock chamber could be effected by using an interior inflatable seal (and not exterior as in the method of embodiment described above). In this case, the inflatable seal is place around part 21 and presses the lateral wall of the pocket towards the exterior, against a fixed ring piece.

The system which is the subject of the invention is not limited to the transfer of sterile products, it is also suitable for the transfer of products or components in which the isolation and confinement in relation to the exterior air must be guaranteed; such as is the case for toxic, harmful, pathogenic, radioactive or air-sensitive products in particular.

The system is particularly suited for use in the pharmaceutical or cosmetics industry, for the transfer of radio-sterilised plastic packaging bottles or components into a sterile enclosure where they will be filled, stoppered, closed, sealed, etc. in a sterile manner.

What is claimed:

1. A transfer system between a bag and a sterile enclosure, comprising:

a) a bag adapted to present at least one mount in the form of a pocket, of which the bottom thereof is defined as a flexible partition which separates the interior spaces of the pocket and the bag, and is able to be heat-cut;

b) an entrance of the enclosure adapted to be equipped with a lock chamber comprising an exterior, fixed part in the form of a sleeve, and an interior, mobile part constituting the door of the lock chamber, such that when the door is located in the exterior, fixed part, said lock chamber is in a closed position;

c) the fixed and mobile parts of said lock chamber are each provided with a heatable blade with closed outline, one exterior integral to the fixed part, and the other interior, integral to the mobile part, these two blades overlapping and being joined at their apex in an airtight manner when the lock chamber is in the closed position;

d) the lock chamber and the mouth of the bag in the form of a pocket are shaped in such a way that it is possible to mount onto the exterior part, the flexible partition then becoming positioned in relation to the set of blades, wherein the lock chamber is closed;

e) the lock chamber is equipped with a plurality of vacuum outlets that apply the flexible partition by means of suction against the heatable blades and effect its cutting by fusion of the areas which come into contact with the blades.

2. The transfer system according to claim 1, wherein the fixed part of the lock chamber has a polygonal-shaped head on which the mouth of the bag is mounted.

3. The transfer system according to claim 2, wherein the lock chamber has a hexagonal-shaped head on which the mount of the bag is mounted.

4. The transfer system according to claim 1, wherein the system includes means for holding the mouth of the bag on the fixed part.

5. The transfer system according to claim 4, wherein the means for holding the mount of the bag on the fixed part is an inflatable sleeve.

6. The transfer system according to claim 1, wherein the vacuum outlets are provided both in the interior and on the exterior of the set of blades.

7. The transfer system according to claim 1, wherein the blades are metal blades heated electrically, wherein the electrical heat is selected from the group consisting of high frequency current and Joule effect.

8. The transfer system according to claim 7, wherein the metal blades are heated by high frequency current.

9. The transfer system according to claim 1, wherein the lock chamber is provided with means of cooling the blades.

10. The transfer system according to claim 1, wherein the blades have a circular outline.

11. The transfer system according to claim 1, wherein the mobile part of the lock chamber is provided with a central sliding element forming a piston, traversed by a vacuum channel and in which the frontal face is adapted to serve as support for the central zone of the partition.

12. The transfer system according to claim 1, wherein the lock chamber is fitted at the entrance to the enclosure in such a way that it can be removed, and an air tight door collar can be fitted in its place.

13. The transfer system according to claim 1, wherein the bag is of a plastic material and is made by heat-sealing from a plastic sheath of sheets and presenting, flat, a transfer zone presenting a mouth constituted by a folded zone that, in use, is expanded to form a pocket with a level bottom adapted to engage on the lock chamber.

14. The transfer system according to claim 13, wherein the transfer zone of the bag is created by a seal in the folded zone comprising a change in direction at an angle greater than or equal to 30 degrees and located at a distance from the fold, and short of it, which is equal to about 0.3 times the opening width of the flattened pocket.

15. The transfer system according to claim 13, wherein the neck above the transfer zone of the bag is shaped in such a way that it can be turned over and threaded onto the fixed part of the lock chamber following opining of the lock chamber, to make a funnel and to protect the contents of the bag from contact with the exterior blade.

16. The transfer system according to claim 13, wherein the bag is shaped in such a way that it is possible to make it temporarily airtight which isolates the interior of the bag from the transfer zone.

17. The transfer system according to claim 13, wherein the internal surfaces of the mouth of the bag in pocket form are protected from contamination by at least on airtight seal.

18. The transfer system according to claim 13, wherein the bag includes at least one inflation appendage.

19. The transfer system according to claim 13, wherein the bag is provided, at its mount, with means of gripping to facilitate the expansion to shape of the pocket and its mounting on the lock chamber.

20. The transfer system according to claim 13, wherein the mouth of the bag is folded double, to form a peripheral groove capable of receiving, by means of interlocking, and element for the expansion to shape and rigidification of the pocket.

21. A bag adapted for use with a transfer system, said transfer system, comprising:

a) a bag adapted to present at least one mount in the form of a pocket, of which the bottom thereof is defined as a flexible partition which separates the interior spaces of the pocket and the bag, and is able to be heat-cut;

b) an entrance of the enclosure adapted to be equipped with a lock chamber comprising an exterior, fixed part in the form of a sleeve, and an interior, mobile part constituting the door of the lock chamber, such that when the door is located in the exterior, fixed part, said lock chamber is in a closed position;

c) the fixed and mobile parts of said lock chamber are each provided with a heatable blade with closed outline, one exterior integral to the fixed part, and the other interior, integral to the mobile part, these two blades overlapping and being joined at their apex in an airtight manner when the lock chamber is in the closed position;

d) the lock chamber and the mouth of the bag in the form of a pocket are shaped in such a way that it is possible to mount onto the exterior part, the flexible partition then becoming positioned in relation to the set of blades, wherein the lock chamber is closed;

the lock chamber is equipped with a plurality of vacuum outlets that apply the flexible partition by means of suction against the heatable blades and effect its cutting by fusion of the areas which come into contact with the blades, said bag being constructed of a plastic material and made by heat-sealing from a plastic sheath or sheets and presenting, flat, a transfer zone presenting a mount constructed of a folded zone that, in use, is expanded to form a pocket with a level bottom adapted to engage on the lock chamber.

22. The bag according to claim 21, wherein the transfer zone is created by a seal in the folded zone comprising a change in direction at a angle greater than or equal to 30 degrees and located at a distance form the fold, and short of it, which is equal to about 0.3 times the opening width of the flattened pocket.

23. The bag according to claim 21, wherein the neck above the transfer zone of the bag is shaped in such a way that it can be turned over and threaded on to the fixed part of the lock chamber following opening of the lock chamber, to make a funnel and to protect the contents of the bag from contact with the exterior blade.

24. The bag according to claim 21, wherein the bag is shaped in such a way that it is possible to make said bag temporarily airtight which isolates the interior of the bag from the transfer zone.

25. The bag according to claim 21, wherein the internal surfaces of the mouth of the bag in pocket form are protected from contamination by at least one airtight seal.

26. The bag according to claim 21, wherein the bag includes at least one inflation appendage.

27. The bag according to claim 21, wherein the bag is provided, at its mouth, with means of gripping, facilitating the expansion to shape of the pocket and its mounting on the lock chamber.

28. The bag according to claim 21, wherein the mount of the bag is folded double, in such a way as to form a peripheral groove capable of receiving, by means of interlocking, an element for the expansion to shape and rigidification of the pocket.

* * * * *